United States Patent [19]

Marechal

[11] 3,982,804

[45] Sept. 28, 1976

[54] SELECTIVE ELECTRICAL CONNECTION DEVICE

[75] Inventor: Gilles Marechal, Paris, France

[73] Assignee: Societe d'Exploitation des Procedes Marechal S.E.P.M., Paris, France

[22] Filed: Mar. 7, 1975

[21] Appl. No.: 556,480

[30] Foreign Application Priority Data

Mar. 14, 1974 France ..... 74.08636

[52] U.S. Cl. ..... 339/41

[51] Int. Cl.[2] ..... H01R 13/44

[58] Field of Search ..... 339/41, 42, 43, 88–90

[56] References Cited

UNITED STATES PATENTS

| | | | |
|---|---|---|---|
| 2,524,250 | 10/1950 | Bierce | 339/41 |
| 3,853,376 | 12/1974 | Marechal | 339/41 |

FOREIGN PATENTS OR APPLICATIONS

| | | | |
|---|---|---|---|
| 1,297,909 | 5/1962 | France | 339/41 |
| 1,448,070 | 6/1966 | France | |
| 832,011 | 2/1952 | Germany | 339/41 |

*Primary Examiner*—Roy Lake
*Assistant Examiner*—Neil Abrams
*Attorney, Agent, or Firm*—Edwin E. Greigg

[57] ABSTRACT

The selective connection device has a safety disc and a complementary disc pivotally mounted on the socket coaxially with the safety disc and displaceable in rotational motion at the same time as the safety disc between the initial position and the final connection position. The complementary disc has a number of openings corresponding to the number of contact locations on the socket and distributed in the same manner. The relative angular position of the socket and of the complementary disc is such that the openings come opposite to the contact locations in the final position.

6 Claims, 5 Drawing Figures

SELECTIVE ELECTRICAL CONNECTION DEVICE

This invention relates to electrical connection devices of the type comprising a plug having multiple contacts which are intended to come into engagement with the corresponding contacts of a socket.

As disclosed in particular in French pat. No. 1,448,070 and its patent of Addition No. 90,457 filed in the name of the present Applicant, it is known to construct a device of this type in such a manner as to ensure that, when employing a single model of socket and plug which are always connected in the same plane of connection, it is impossible to associate two elements which are not connectable by reason of the nature of the currents corresponding to each element. Stated in different terms, if a plug penetrates into a socket in a device of this type, it is because the socket can supply the current which the plug is intended to use and, conversely, if a plug cannot penetrate into a socket, it is because this latter cannot supply the current which is necessary.

As in the patent cited in the foregoing, the invention is primarily although not exclusively directed to the case of a socket having four contacts or poles distributed over a circumference and if necessary a ground contact which is placed at the center (and to which further reference will be made hereinafter), the four poles being uniformly spaced angularly except for one pole which is relatively displaced.

Each of the two elements, namely the plug and the socket, is constituted by a casing and an insulating contact support adjustably mounted in relative orientation with respect to said casing and the casings of the two elements carry combined means for guiding and locking by rotation which are so arranged as to ensure that said elements can be joined together only in a single relative angular position.

Differentiation of the sockets which are supplied in different ways (for example: three-phase supply at 500 volts, three-phase supply at 380 volts, single-phase supply at 110 volts, single-phase supply 24 volts, and so forth) and of the corresponding plugs is carried out by assigning to each nominal current a predetermined relative angular position of the contact support within its casing. When the number of these different relative positions is sufficient (of the order of 20), that is to say at least equal to the number of industrial currents normally employed, it is possible to fix once and for all the position corresponding to a predetermined current and thus to establish a standardization system which is valid for the entire industry.

Furthermore, a safety disc of insulating material which is pivotally mounted on the socket so as to permit displacement in rotation coaxially with the circumference of the contacts by the plug at the time of interlocking of this latter with said socket is provided with openings through which the plug contacts are intended to pass, said openings being distributed over a circumference in superposed relation to the contact circumference and are so arranged that only a certain number of contact positions are uncovered at the end of the interlocking movement of rotation, means being provided for ensuring that said safety disc is locked at the time of separation of the plug from the socket in an initial position in which all the contacts are covered.

In the known devices, the safety disc is locked in the initial position chosen by ensuring that at least one nose carried by a washer surrounding the contact support is engaged with one of a plurality of slots arranged at intervals at the periphery of the disc, the washer being urged towards the disc by a resilient means and locked in rotation by guiding means adapted to cooperate with corresponding means carried by the casing of the socket. The washer is thrust back by the plug at the time of insertion of this latter into the socket.

Addition No. 90,457 to U.S. Pat. No. 1,448,070 cited in the foregoing shows that the angular displacement $\phi$ between two consecutive positions of a contact support must be 15° or 18° permitting respectively 24 and 20 relative angular positions, each position being such as to correspond to a predetermined current value and that, in the case of a maximum number of four poles, that is to say a neutral N and three phase contacts, the best distribution of these contacts on their circumferences of positional location consists in disposing the phase contacts as designated hereinafter by the references 1, 2 and 3 at intervals starting from neutral at the positional locations 90°, 180° and 270° + $\phi$ in the reverse direction on a front view of the socket. It has also been shown that, in order to uncover the contact positions 1 and 2 or
1, 2 and 3 or
1, 2, 3 and N or
1, 2 and N or
1 and N starting from five initial positions, the safety disc had to have six openings arranged at intervals starting from one of these latter which is taken as the point of origin, either at $\phi$°, 90°, 180°, 180° + $\phi$ and 270° + $\phi$ in the reverse direction or at 90°, 90° + $\phi$, 180°, 180° + $\phi$ and 270° + $\phi$ in the reverse direction.

The non-interchangeability, that is to say the impossibility of connecting a plug and a socket having contact supports which are not mounted in the same angular position permits an exception in regard to the two-pole plugs which do not make use of the displaced contact 3. In fact, the plug N-1 of one position is capable of penetrating into the contacts 1-2 of a socket having a position displaced by + 90°. Similarly a plug 1-2 will penetrate into the contacts N-1 of a socket which is displaced by −90° and a plug N-2 will penetrate into the contacts 2-N of a socket which is displaced by 180°. The case just mentioned is not to be considered in the combination chosen and recalled in the foregoing since the plugs N-2 are not employed. On the other hand, the two first cases are possible and entail the need to make a suitable choice of the currents assigned to the positions displaced by + or − 90°. From this it follows for example that, starting from a position assigned to alternating current at 380° volts, the position displaced by +90° will be assigned to alternating current at 220 volts. Thus the single-phase plug 1-2 of the position just mentioned will be capable of penetrating into the first socket in 1 and N and will nevertheless receive a correct current. It is also possible to distribute the currents in the various positions in such a manner as to ensure that a plug 1-2 cannot penetrate into the contacts N-1 of the position displaced by −90° by assigning to this position a current which never employs the contact N, the safety discs being in that case mounted on the corresponding sockets in initial positions which do not make it possible to uncover said contact N.

While it is therefore relatively easy to arrange the distribution of alternating currents between the various angular positions of the contact supports, the same does not apply to direct currents. So far as these latter are concerned, non-interchangeability must be total and it is impossible to employ the contacts N-1 or 1-2 in the case of direct currents and it is absolutely essential to employ the displaced contact 3 for one of the poles. There is no position of the safety disc, however, which makes it possible to uncover only the contacts 3-N or 3-1 or 3-2.

This problem is solved by French Pat. No. 72 46,828 filed in the name of the present Applicant. In this patent, provision is made for a safety disc which serves to uncover the positions of the contacts N-2 and 3, the socket contact 3 being supplied positively and the contact 2 being preferably supplied negatively. This solution is imperfect since it entails the need to uncover an unused contact position.

Moreover, as shown in particular in the certificate of Addition No. 90,457 cited earlier, the angle $\theta$ through which the safety disc is intended to be rotated between its initial position and its corresponding position of utilization (this angle being equal to the interlocking rotation of the plug on the socket) must satisfy the two following inequalities: $\theta + V \leq 90° - 2\phi$ and $\theta - \phi$ $V$ wherein:

$\phi$ is the angular displacement of the contact 3 with respect to a uniform distribution of the contacts and usually equal to the angular displacement of two consecutive positions of a contact support within its casing, $V$ is the minimum interlocking angle between an opening of the disc and a contact position (we have $$V = 2 \text{ arc sin } \frac{D}{2R},$$

where $D$ is the diameter of an opening of the disc and $R$ is the radius of the circumference of positional location of the contacts of the plug and of the socket).

This double condition in respect of $\theta$ entails the need in some cases for an interlocking rotation of fairly considerable amplitude and limits the possibilities of arrangement of the openings on the safety disc.

Finally, if for any reason it becomes necessary to reduce $R$ or to increase $D$ (for example in order to employ connector-pins of larger diameter for reasons of electrical or mechanical resistance), it may happen that the end result is an impossibility or at least that some contact locations are at least partly uncovered in the initial position of the safety disc.

These disadvantages of various types all arise from the fact that the safety disc has a double function, namely: to cover all the contact locations in the initial position, to uncover predetermined contact locations in the final position of connection.

It is for the reason just mentioned that the invention proposes to dissociate the two functions.

The invention relates to an electrical connection device with safety disc of the type hereinabove described in which a second so-called complementary disc is pivotally mounted on the socket coaxially with the safety disc and is so arranged as to be displaced in rotational motion at the same time as said safety disc between the initial position and the final position of connection, said complementary disc being provided with a number of openings corresponding to the number of contact locations on the socket, said openings being distributed in the same manner as said locations whilst the relative angular position of the socket and of the complementary disc is such that said openings come into position opposite to said contact locations in the final position.

It is readily apparent that the relative angular position of the complementary disc and of the socket is independent both in regard to the position of said socket in its casing and in regard to the initial position selected for the safety disc. The initial position of the complementary disc is obtained from the coincidence of its openings with the contact locations of the socket by a reverse movement of rotation having the same amplitude as the interlocking movement of rotation.

Thus the function which consists in covering all the contact locations in the initial position devolves upon the complementary disc alone. To this end it is necessary and sufficient to ensure that the amplitude of the interlocking rotation is different from each of the angular intervals of the contact locations to within V $$(V = 2 \text{ arc sin } \frac{D}{2R}) \quad ,$$

thus allowing a wide range of choice.

The function of selection of contact locations to be uncovered in the final position is assigned to the safety disc by the choice of the relative position of this latter with respect to the socket as in existing devices. But since it matters little if some openings are in vertically opposite relation to certain contact locations in the initial position, the choice of the number and distribution of these openings is then very much broader and makes it possible in particular to make arrangements for obtaining in the final position the selection of only two contact locations including the displaced contact, thus solving the problem of distribution of direct currents.

A more complete understanding of the invention will be gained from the following description of one possible embodiment which is shown diagrammatically in the accompanying drawings, wherein.

Figure 1:
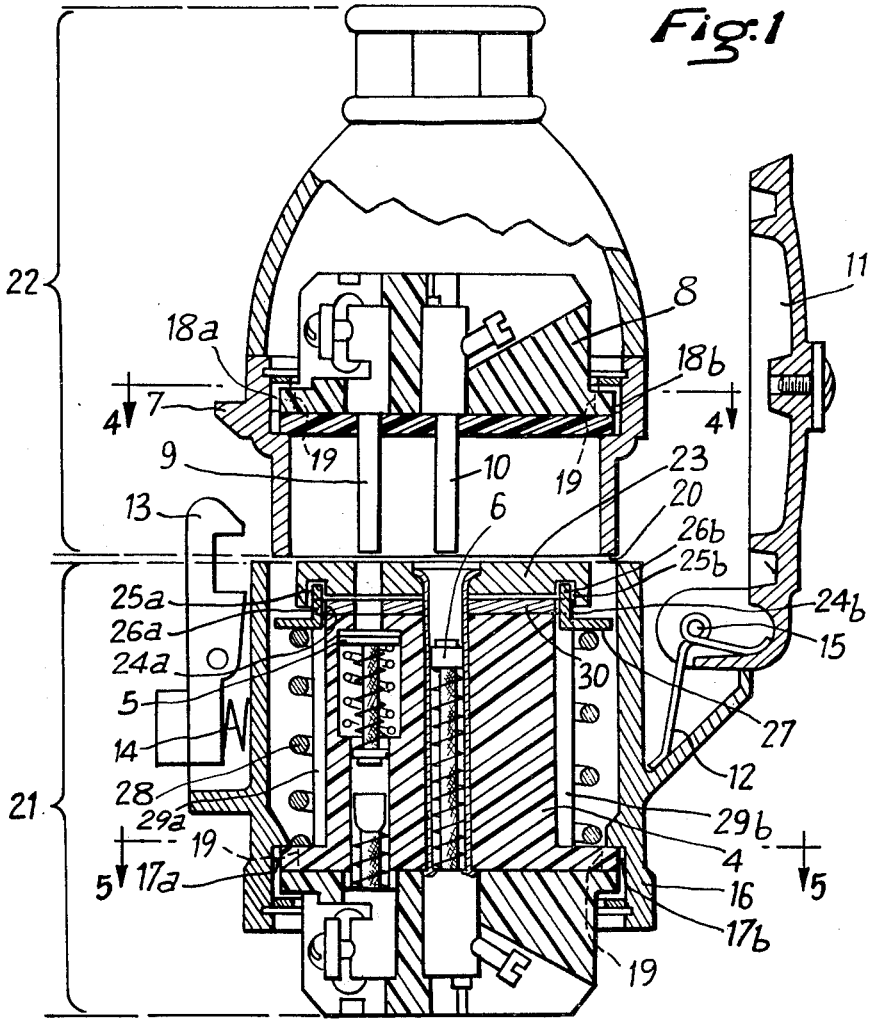
FIG. 1 is a longitudinal sectional view of a connection device in accordance with the invention.

The electrical connection device shown in FIG. 1 is essentially composed of two assemblies, namely a stationary assembly designated by the reference 21 to which the term of "socket" will be applied hereinafter and a movable assembly designated by the reference 22 to which the term of "plug" will be applied hereinafter.

The socket itself comprises an external metallic casing 16 containing an insulating support member 4 in which are mounted four contacts as designated by the reference 5 and referred-to in the following description as socket contacts, and a central ground contact 6. The plug comprises an external metallic casing 7 containing an insulating support 8 in which are mounted electrical contacts as designated by the element 9 and referred-to in the following description as plug contacts, and a central ground contact element 10. When the plug is withdrawn from the socket, a cover 11 can be swung back about its hinge-pin 15 on the socket 21 in opposition to the spring 12 and locked in the closed position by the catch 13, said catch being in turn maintained by the spring 14.

Figure 2:
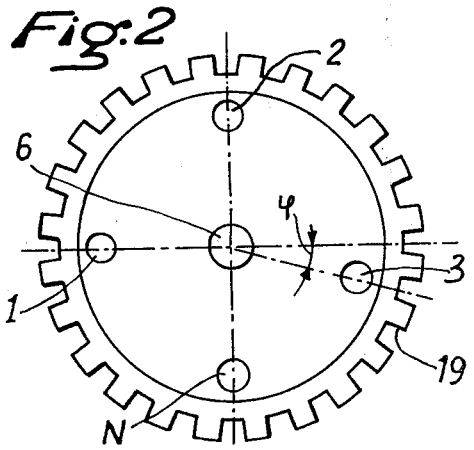
FIG. 2 is a diagrammatic top view of the socket showing the arrangement of the contact locations.

The four socket contacts are disposed in a standard arrangement on the same circumference in concentric relation to the connecting device as a whole and consist of a neutral contact N and three phase contacts designated respectively by the references 1, 2 and 3 (as shown in FIG. 2). The three first contacts N, 1 and 2 are separated on the circumference by arcs each subtending an angle of 90° whilst the fourth contact 3 is displaced through an angle $\phi$ with respect to the regular division. In the example illustrated, $\phi$ is equal to 15° and the circumferential arc between the contacts 2 and 3 is then 105°. In known manner, $\phi$ could also be equal to 18°.

The positional locations of the plug contacts are adapted to correspond to the socket contacts but the only contacts to be equipped are those which correspond to the current required for the circuit to be supplied.

The insulating support 4 of the socket and the insulating support 8 of the plug are each provided with a plurality of peripheral grooves such as the groove 19 (shown in FIG. 2), the angular distance between said grooves being $\phi°$. In the example shown, there are therefore twenty-four grooves disposed at intervals of 15° and adapted to cooperate with two positioning lugs 17*a*, 17*b* and 18*a*, 18*b* respectively, said lugs being integral with the corresponding casing. Each insulating support is thus capable of taking up twenty-four relative angular positions with respect to its casing.

A predetermined relative position is associated with a predetermined current according to the nature and rms voltage of this latter, e.g. 380 volts A.C., 220 volts A.C., 110 volts D.C., 48 volts A.C., 24 volts D.C., and so forth.

The plug casing 7 can be inserted axially into the socket casing 16 only in a well-determined angular position, for example by virtue of the presence of a lug (not shown in the drawings) which is rigidly fixed to one of the two casings and so arranged as to ensure that full engagement of the plug within the socket is performed in three stages. Thus a first stage consists in introducing the plug into the socket in an axial movement of translation, a second stage consists in initiating a relative movement of rotation of the two casings through a predetermined angle which brings the plug contacts into oppositely facing relation with the socket contacts; a third and last stage consists in carrying out the effective engagement of the contacts by inserting the plug into the socket in a second movement of axial thrust. This arrangement is obtained by means of a bayonet assembly of any suitable and conventional type.

There are pivotally mounted on the insulating support 4 of the socket a safety disc 23 and a complementary disc 30 both of which are maintained against the insulating support 4 of the socket by means of the head of the central ground contact 6 which serves at the same time as a pivot for said discs.

The lateral cylindrical face of the complementary disc 30 is provided with two diametrically opposite slots 24*a* and 24*b* and the safety disc is provided in the vicinity of its periphery with a plurality of cavities such as those designated by the references 25*a* and 25*b* which are disposed at intervals on its lower face for a purpose that will be explained hereinafter.

The complementary disc 30 is provided with a central opening and with four openings distributed exactly in the same manner as the socket contacts and on a circumference having the same radius as the circumference of distribution of these latter. The safety disc is provided in known manner with a central opening and with a plurality of openings located on a circumference which is equal to the circumference of distribution of the contacts.

The pivotal discs 23 and 30 take up an initial position which is invariably fixed with respect to the socket from the moment of positioning of said discs at the time of installation of the connecting device, said initial position being always the same for the complementary disc 30 and being chosen at the moment of installation as a function of the polarity of the socket for the safety disc 23 as will be explained hereinafter.

This initial positioning is carried out by means of two noses 26*a* and 26*b* which project from a safety washer 27, said noses being intended to engage both through the slots 24*a*, 24*b* of the disc 30 and within two of the cavities such as 25*a*, 25*b* of the safety disc 23. The safety washer 27 is secured only against rotational displacement with respect to the socket support 4 by means of two tongues directed radially towards the interior, said tongues being engaged respectively in two longitudinal grooves 29*a*, 29*b* formed in the lateral surface of the contact support. Each of these tongues has an end portion which is bent back at right angles and thus forms a nose 26*a*, 26*b*. The washer 27 is urged towards the discs by a spring 28 which surrounds the body of the insulating support 4 of the socket.

When the plug is inserted longitudinally in the initial stage of positioning of the plug within the socket, the front end 20 of the plug casing 7 thrusts back the safety washer 27 in opposition to the spring 28 and consequently releases the noses 26*a*, 26*b* which serve to interlock the discs. At the same time, the plug contacts such as 9 engage in the openings of the discs 23 and 30 and these latter are accordingly coupled for rotation with the plug. Said discs will therefore rotate with said plug during the time of rotation of the bayonet movement by virtue of the plug contacts which cooperate with said openings.

It is readily apparent that the final angular position of the complementary disc 30 with respect to the socket support 4 must be that in which the openings of the disc 30 are located respectively opposite to the socket contacts N, 1, 2 and 3. Starting from this final position, the initial angular position of the disc 30 is therefore obtained by means of a movement of rotation which is equal and of opposite direction to the interlocking movement of rotation of the plug on the socket. It is therefore only necessary to arrange the slots 24*a* and 24*b* in the disc 30 so as to ensure that, in this initial position, said slots are located opposite to the longitudinal grooves 29*a*, 29*b* of the support 4.

The complementary disc 30 is intended to cover all the socket contacts when said disc is located in its initial position. With this objective, it is only necessary to ensure that, in said initial position, none of the disc openings other than the central opening is either coaxial or secant in projection with a contact orifice of the socket.

If $\theta$ designates the amplitude of interlocking rotation, D designates the diameter of an opening, R designates the radius of the circumference of positional location of the contacts, $\alpha$ designates the angular interval between the contacts N-1 and 1-2, $\beta$ designates the angular interval between the contacts 2-3 and $\beta'$ designates the angular interval between the contacts 3-N, this condition is satisfied when $\theta$ is different both from V, from $\alpha \pm V$, from $\beta \pm V$ and $\beta' \pm V$, wherein $$V = 2 \text{ arc sin } \frac{D}{2R}$$

in the foregoing expressions.

It is known that, in the case of the different connection calibers and in the case of the minimum dimensions which are compatible with essential electrical and mechanical requirements, D/2R is substantially constant and that V is accordingly equal to 22°.

The angles $\beta$ and $\beta'$ always differ from $\alpha$ by a value which is smaller than 2V. In other words, the prohibitions by $\theta$ overlap to a partial extent and make it necessary to ensure that $V \leq \theta \leq \beta' - V$ ($\beta'$ being the angular distance between two adjacent contacts.

In the example which is illustrated, $\beta' = 75°$, the sole condition thereby imposed when $V = 22°$ being that $22° \leq \theta \leq 53°$.

The choice in regard to the value $\theta$ is fairly broad and makes it possible to determine the bayonet-type engagement of the plug and socket as a function of mechanical requirements of manufacture.

However, the advantage of the complementary disc 30 lies primarily in the fact that the openings of the safety disc can accordingly be provided without any restriction in regard to either number or positional location.

Figure 3:
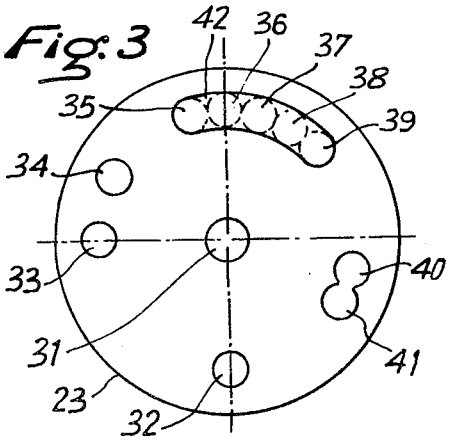
FIG. 3 is a diagrammatic top view of the safety disc.
Figure 4:
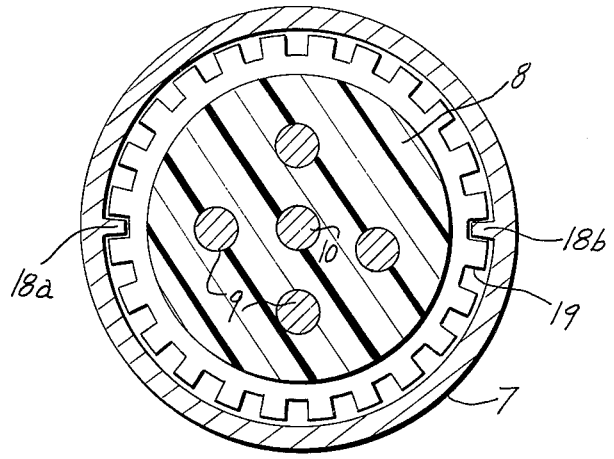
FIG. 4 is a view on line 4—4 of FIG. 1.
Figure 5:
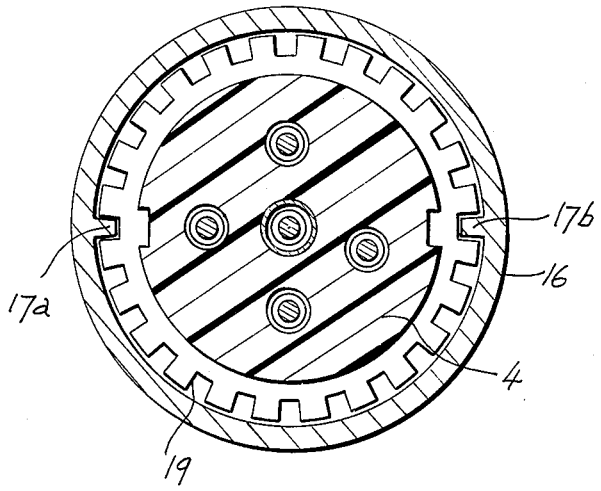
FIG. 5 is a view on line 5—5 of FIG. 1.

In order to illustrate this facility, FIG. 3 shows diagrammatically a safety disc which is provided by way of example with ten peripheral openings and makes it possible to obtain from ten predetermined initial positions and ten possible combinations of the four contacts N, 1, 2 and 3 taken either together or 3 by 3 or 2 by 2.

The safety disc 23 is provided with a central opening 31 and with ten peripheral openings 32 to 41 disposed on a circumference which is equal to the circumference of positional location of the socket contacts, starting from one opening 32 taken as a point of origin, respectively at 90°, $90° + 2\phi$, $180° - \phi$, 180°, $180° + \phi$, $180° + 2\phi$, $180° + 3\phi$, $270° + \phi$ and $270° + 2\phi$ in the reverse direction or in the example which is illustrated ($\phi = 15°$) at 90°, 120°, 165°, 180°, 195°, 210°, 225°, 285° and 300°.

If the contact support 4 is placed within its casing in a relative angular position corresponding to FIG. 2 whilst FIG. 3 represents the final position of the safety disc 23 at the end of a movement of rotation of said disc which starts from a given initial position, it is clear that all the contacts N-1-2 and 3 are accessible in this final position.

An angular displacement of the initial position of the disc 23 with respect to the socket and consequently of its final position since the amplitude of the pluglocking movement of rotation is constant serves to uncover the following contacts and only said contacts:

| | |
|---|---|
| Displacement by $+ \phi°$ | : 2 and 3 |
| Displacement by $+ 2\phi°$ or by $90° + \phi$ | : 1 and 2 |
| Displacement by $+ 90° - \phi$ | : 1 and 3 |
| Displacement by $- (90° - \phi)$ or by $180° - \phi$ | : N and 3 |
| Displacement by $+ 90°$ | : N and 1 |
| Displacement by $- 90°$ | : 1 - 2 and 3 |

-continued

| | |
|---|---|
| Displacement by $+ 90° + 2\phi$ | : N - 1 and 2 |
| Displacement by $+ 180° + \phi$ | : N - 1 and 3 |
| Displacement by $- (90° - 2\phi)$ | : N - 2 and 3 |

It should further be noted that a displacement through an angle of $\pm 180°$ makes it possible to uncover only the contacts N and 2 but this combination is not desirable for other reasons.

Thus the safety disc shown in FIG. 3 serves to obtain all possible combinations of the four contacts. This arrangement, however, is given only by way of example since other locations are possible for the openings and some of these latter may be dispensed with when it is not necessary to obtain all the possible combinations.

In order to obtain the ten initial positions which are necessary, it need only be ensured that the bottom face of the safety disc 23 is provided with twenty suitably placed cavities which are diametrically opposite in pairs such as those designated by the references 25*a* and 25*b*. In practice, these cavities will be spaced at uniform intervals of $\phi$ at $\phi°$, that is to say exactly twenty in number in respect of $\phi = 18°$ and 24 in number (20 of which can be employed) in respect of $\phi = 15°$.

The five contiguous openings 35 to 39 can be grouped together within an oblong slot 42 in the shape of a circular arc. The two contiguous openings 40 and 41 can also form a single slot but this latter must retain the shape of a figure eight in order to permit correct displacement of the safety disc by the plug contacts when use is made of a twopole plug N-3 or 2-3.

It will be readily understood that many detail modifications can be made in the form of construction described with reference to the accompanying figures without thereby departing from the scope of the invention. From this it follows that any suitable means may be employed for locking the plug on the socket. The same applies to the means for positioning the insulating supports within their respective casing or alternatively to the means for locking the safety disc and the complementary disc in their initial positions. It should finally be noted that the arrangement of the safety disc and of the complementary disc can be reversed or in other words that the complementary disc can cover the safety disc.

I claim:

1. A selective electrical connection device comprising a housing arranged to support a centrally perforated insulating socket member having an end wall, said socket member having a plurality of means defining openings therein arranged in predetermined spaced relation around said central perforation and adapted to slidably support electrical contact means, plural juxtaposed disc members associated with said end wall of said socket member, resilient means encompassing said socket member and adapted to support a washer means, said washer means including means cooperating with said juxtaposed disc members to prevent inadvertent rotary movement thereof, plug means arranged for assembly with said insulating support member, said plug means having a collar element arranged to be interposed between the socket member and the housing upon electrical connection being established, a central ground contact element for cooperation with said perforation in said socket member and a further electrical contact element laterally spaced therefrom supported on said plug means arranged to be associated with at least one of said electrical contact means spaced around said central perforation in said socket member when said collar element is inserted into said housing to depress said resilient means thereby disengaging said washer from said juxtaposed disc members to permit relative rotation thereof and engagement of said electrical contact element with at least one of said electrical contact means carried by said socket member.

2. A selective electrical connection device as claimed in claim 1, in which the socket member has an exterior wall provided with means serving to assure rectilinear reciprocation of said washer means.

3. A selective electrical connection device as claimed in claim 1, in which each of said disc members are constructed of insulative material.

4. A selective electrical connection device as claimed in claim 1, in which the said disc member that engages the end wall of said socket member is provided with a plurality of peripheral grooves which are arranged to cooperate with said means on said washer means.

5. A selective electrical connection device as claimed in claim 4, wherein the said disc member engaging the end wall of said socket member is provided with at least four means defining openings therein.

6. A selective electrical connection device as claimed in claim 4, in which the said disc member supported by said disc member engaging said end wall of said socket member is provided with at least five openings therein, one of which forms a circular arc capable of accomodating said further electrical contact element carried by said plug means in five different positions.

* * * * *